US008154468B2

(12) United States Patent
Ke et al.

(10) Patent No.: US 8,154,468 B2
(45) Date of Patent: Apr. 10, 2012

(54) MULTI-BAND ANTENNA

(75) Inventors: Yun-Lung Ke, Tu-cheng (TW); Po-Kang Ku, Tu-cheng (TW); Chen-Ta Hung, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 430 days.

(21) Appl. No.: 12/322,535

(22) Filed: Feb. 3, 2009

(65) Prior Publication Data

US 2009/0195473 A1 Aug. 6, 2009

(30) Foreign Application Priority Data

Feb. 4, 2008 (TW) ..... 97104105 A

(51) Int. Cl.
*H01Q 13/10* (2006.01)

(52) U.S. Cl. ..... 343/846

(58) Field of Classification Search ..... 343/700 MS, 343/846, 848, 702
See application file for complete search history.

(56) References Cited

U.S. PATENT DOCUMENTS

| | | | | |
|---|---|---|---|---|
| 5,926,150 | A * | 7/1999 | McLean et al. | 343/846 |
| 6,812,892 | B2 * | 11/2004 | Tai et al. | 343/700 MS |
| 6,861,986 | B2 | 3/2005 | Fang et al. | |
| 7,119,747 | B2 * | 10/2006 | Lin et al. | 343/702 |
| 7,375,685 | B1 * | 5/2008 | Nalbandian | 343/700 MS |
| 7,466,272 | B1 * | 12/2008 | Su et al. | 343/700 MS |
| 7,728,783 | B2 * | 6/2010 | Su et al. | 343/846 |
| 2005/0190108 | A1 * | 9/2005 | Lin et al. | 343/702 |
| 2006/0145934 | A1 * | 7/2006 | Park et al. | 343/702 |

* cited by examiner

*Primary Examiner* — Huedung Mancuso
(74) *Attorney, Agent, or Firm* — Wei Te Chung; Andrew C. Cheng; Ming Chieh Chang

(57) ABSTRACT

A multi-band antenna includes a grounding element located on a first planar, a connecting element, a first radiating portion, and a second radiating portion. The connecting element is substantially of L-shape configuration and located on the first planar. The first radiating portion, with a free end, extends from connecting element. The second radiating portion, with a free end, extends from the connecting element and is separated from the first radiating element. The free end of the first radiating portion and the free end of the second radiating portion extend in the same direction.

10 Claims, 3 Drawing Sheets

MULTI-BAND ANTENNA

BACKGROUND OF THE INVENTION

1. Field of the Invention

The present invention relates generally to a multi-band antenna, and more particularly to a multi-band antenna suitable for building into an electronic device, such as a notebook.

2. Description of the Prior Art

In recent years, antennas working for Wireless Local Area Net (WLAN) become basic components in wireless communication devices. The inner antennas are of the smaller the better. U.S. Pat. No. 6,861,986, issued to Fang et al on Mar. 1, 2005, discloses a multi-band antenna which is a type of planar invert-F antennas. The multi-band antenna comprises a radiating element, a grounding element and a connecting element connecting the radiating element to the grounding element. The radiating element comprises a first radiating portion extending from the connecting element along a first direction and a second radiating portion extending from the connecting element along a second direction opposite to the first direction. The connecting element is configured of three side arms. However, those two radiating portions respectively extending along two opposite directions and the connecting portion with three side arms make the multi-band antenna too long and too wide to be fit into a panel of a notebook computer.

Hence, in this art, a multi-band antenna to overcome the above-mentioned disadvantages of the prior art should be provided.

BRIEF SUMMARY OF THE INVENTION

A primary object, therefore, of the present invention is to provide a multi-band antenna with small structure.

In order to implement the above object, the multi-band antenna made in accordance with the present invention comprises a grounding element located on a first planar, a connecting element being substantially of L-shape configuration and located on the first planar, a first radiating portion and a second radiating portion. The first radiating portion, with a free end, extends from connecting element to form a free end. The second radiating portion, with a free end, extends from the connecting element to form a free end and is separated from the first radiating element. The free end of the first radiating portion and the free end of the second radiating portion extend in the same direction.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
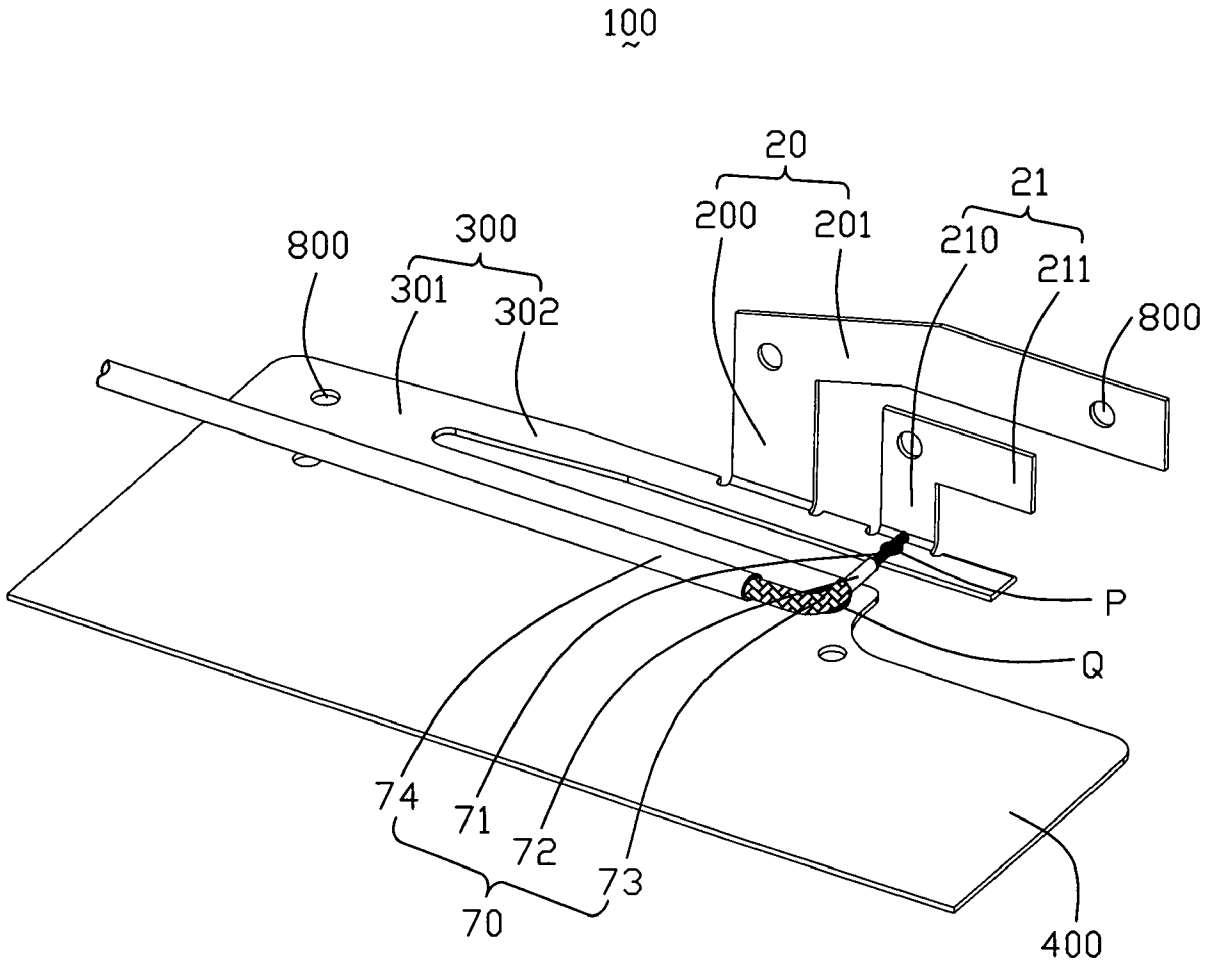
FIG. 1 is a perspective view illustrating a first embodiment of a multi-band antenna in according with the present invention.
Figure 2:
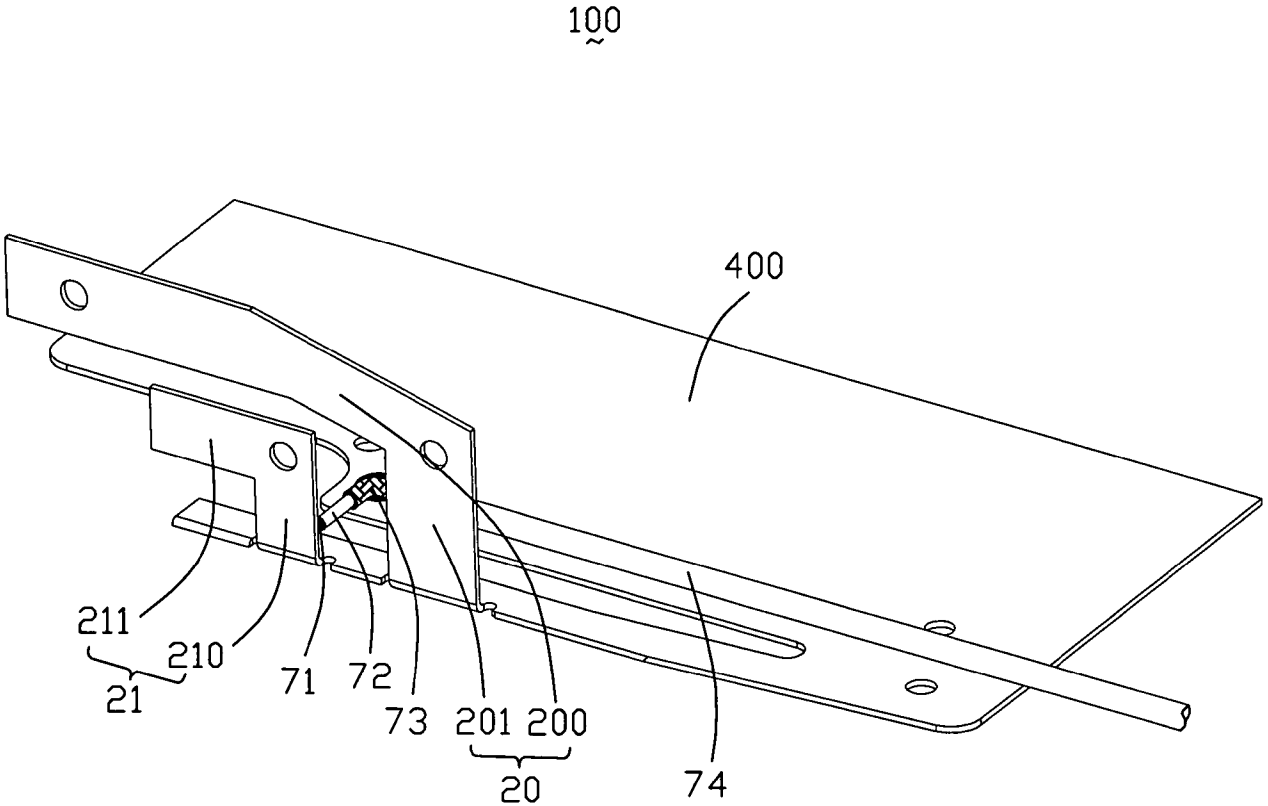
FIG. 2 is a perspective view of FIG. 1, but viewed from another angle.

Reference to FIG. 1, a multi-band antenna made in according with a first embodiment of the present invention is shown. In the first embodiment, the multi-band antenna 100 is intended for being built in an electric device such as a notebook to transmit signals. The multi-band antenna 100 is made by a metal patch and comprises a rectangular grounding element 400 which is located on a first plane, a first radiating portion 20 and a second radiating portion 21 both of which are arranged/located above the grounding element 400 to be separated from the grounding element 400. The multi-band antenna further comprises a connecting portion 300 connecting the first and second radiating portions 20, 21 to the grounding element 400, and a feeding line 70.

The grounding element 400 has at least one aperture 800 to attach the antenna 100 on the electric device. In this embodiment, the grounding element 400 has an optional cutout to adapt to the inner space of the electric device, but in other embodiment it may not include this optional cutout.

Figure 3:
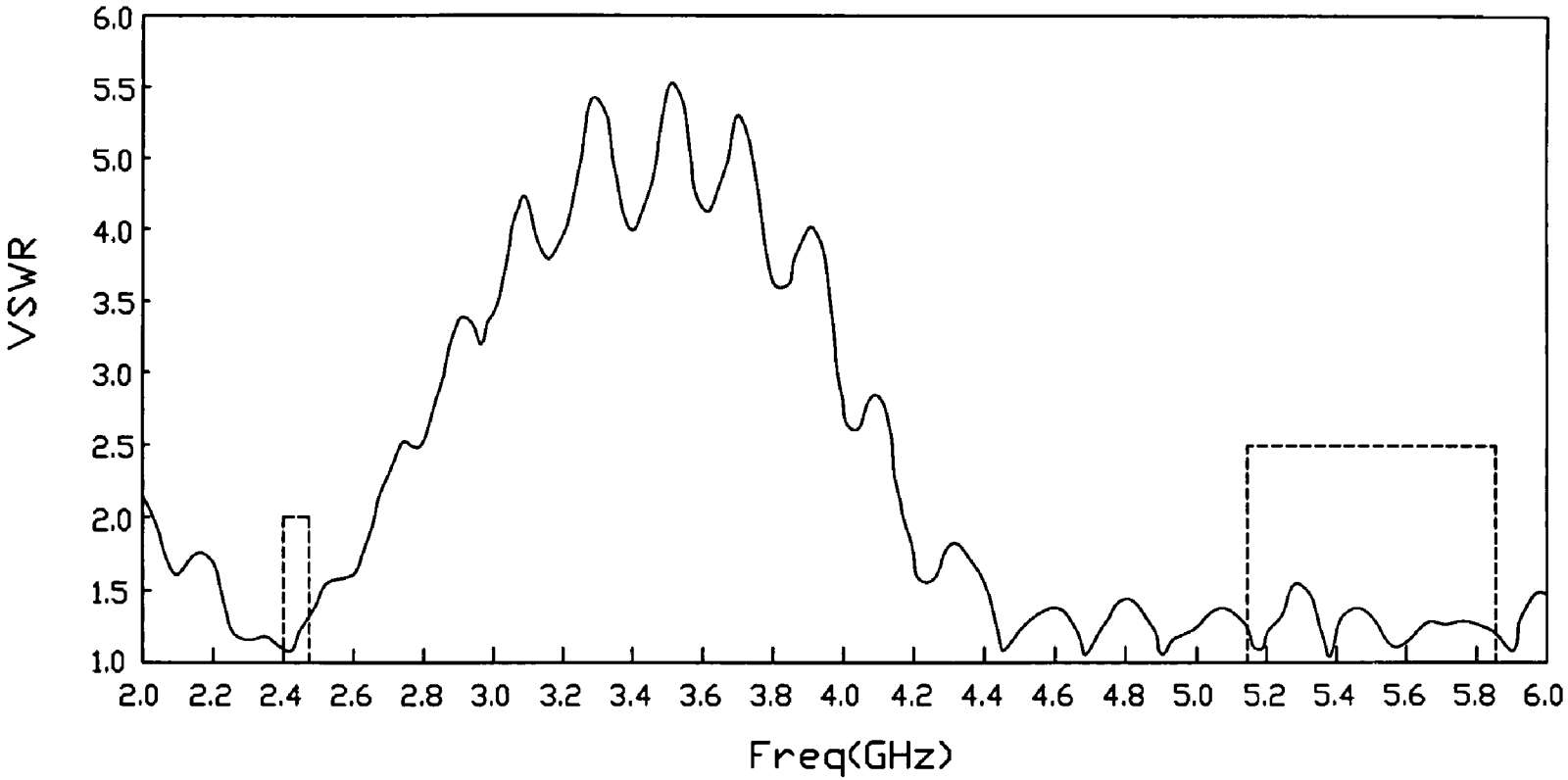
FIG. 3 is a test chart recording for the multi-band antenna of FIG. 1, showing Voltage Standing Wave Ratio (VSWR) as a function of WLAN frequency.

The first radiating portion 20 is substantial of L-shape configuration and extends from the middle of the connecting element 300 with a free end pointing rightward, as seeing from the Figure. The first radiating portion 20 comprises a first radiating arm 200 extending vertically and orthogonally connected to the connecting portion and a second radiating arm 201 extending horizontally from the end of the first radiating arm 200. In the first embodiment, the second radiating arm 201 extends not along a line to adapt to the inner space of the electric device, but in other embodiment the second radiating arm 201 can extend along a line. The second radiating portion 21, with a free end, is of L-shape configuration and extends from the connecting element 300 at another position different from the position the first radiating portion 20 extends from. The second radiating portion 21 comprises a third radiating arm 210 extending upwardly from the connecting element 300 in a direction perpendicular to the connecting element 300 and a fourth radiating arm 211 extending from the third radiating arm 210 in a direction perpendicular to the third radiating arm 210. The free end of the second radiating portion 201 and the free end of the fourth radiating portion 211 extend along a same first direction. The first radiating portion 200 is parallel to the third radiating portion 210 and the second radiating portion 201 is parallel to the fourth radiating portion 211. At least one radiating portion of the two radiating portions 20, 21 has at least one aperture 800. Both the first radiating portion 20 and the second radiating portion 21 are at a second planar perpendicular to the first planar, and the second radiating portion 21 is between the first radiating portion 20 and the grounding element 300. The first radiating portion 20 is used to receive and send signals at a lower frequency band, and the second radiating portion 21 resonates on a higher frequency band. Reference to FIG. 3, the multi-band antenna works at a lower frequency band on 2.1 GHz-2.6 GHz and a higher frequency band on 5.2 GHz-5.8 GHz.

The connecting element 300 is of L-shape configuration and locates on the first planar. The connecting element 300 comprises a first side arm 301 extending from one side of the grounding element 400 and a second side arm 302 extending from the end of the first side arm 301 in a direction perpendicular to the first side arm 301. The first side arm 301 is wider than the second side arm 302. A slot is formed between the second side arm 302 and the grounding element 400.

The feeding line 70 comprises an inner conductor 71, an inner insulative layer 72 surrounding the inner conductor 71, an outer conductor 73 wrapping the inner insulative layer 72, and an outer cover 74 surrounding the outer conductor 73. The inner conductor is connected to a point P which is the joint of the second side arm 302 of the connecting element 300 and the second radiating portion 21, and the outer conductor 73 is connected to the grounding element 400 to form a grounding point Q.

The apertures 800 on the grounding element 400 and the radiating portions 20, 21 are used to form hot-melting holes. Thus, when the electric device comprises an insulative supporting portion (not shown) with hot-melting blocks, the multi-band antenna 100 can be fix on the insulative supporting portion through heating-fusing method.

What is claimed is:

1. A multi-band antenna, comprising:

a grounding element, located on a first plane;

a connecting element, being substantially of L-shape configuration and located on the first plane;

an L-shape first radiating portion, with a free end and perpendicularly extending from connecting element, said first radiating portion comprising a vertical first radiating arm orthogonal connected to the connecting element and a horizontal second radiating arm extending from the end of the first radiating arm; and an L-shape second radiating portion, with a free end and perpendicularly extending from the connecting element and separated from the first radiating element, said second radiating portion comprising a third radiating arm upwardly extending from the connecting element in a direction perpendicular to the connecting element and a fourth radiating arm extending from the third radiating arm in a direction perpendicular to the third radiating arm;

said free end of the first radiating portion and the free end of the second radiating portion extending in the same direction.

2. The multi-band antenna as claimed in claim 1, wherein said second radiating arm is parallel to the fourth radiating arm, said first radiating arm is parallel to the third radiating arm.

3. A multi-band antenna comprising:

a grounding element;

a connecting element unitarily extending from the grounding element with therebetween a slot extending along a lengthwise direction;

a first L-shape radiating portion unitarily extending from a first position of a longitudinal side edge of the connecting element which extends along the lengthwise direction;

a second L-shape radiating portion unitarily extending from a second position of said longitudinal side edge spaced from the first position in said lengthwise direction; wherein said second radiating portion is essentially disposed in a space defined between the first radiating portion and the longitudinal side edge.

4. The multi-band antenna as claimed in claim 3, wherein said first radiating portion and said second radiating portion direct to a same direction.

5. The multi-band antenna as claimed in claim 3, wherein said first radiating portion and said second radiating portion are located in a first plane while said grounding element is located in a second plane different from said first plane.

6. The multi-band antenna as claimed in claim 3, wherein the slot is open to an exterior in said same direction.

7. The multi-band antenna as claimed in claim 3, further including a feeder cable having an inner conductor mechanically and electrically connected to the connecting element and an outer conductor mechanically and electrically connected to the grounding element.

8. The multi-band antenna as claimed in claim 3, wherein said longitudinal side edge is spaced from the slot.

9. A multi-band antenna comprising:

a grounding element defining a lengthwise direction;

a connecting element unitarily extending from the grounding element with therebetween a slot extending along said lengthwise direction;

a first radiating portion unitarily extending from a first position of a longitudinal section of the connecting element which extends along said lengthwise direction;

a second radiating portion unitarily extending from a second position of the longitudinal section of the connecting element different from the first position in the lengthwise direction; wherein said first radiating portion and the second radiating portion are located in a first plane which is different from a second plane in which said grounding element is located.

10. The multi-band antenna as claimed in claim 9, wherein said connecting element is located in the same plane with the grounding element.

* * * * *